US006550523B1

(12) United States Patent
Chen

(10) Patent No.: US 6,550,523 B1
(45) Date of Patent: Apr. 22, 2003

(54) HEAD STRUCTURE FOR VENETIAN BLIND

(76) Inventor: Her Hsiung Chen, 15F, No. 369, Fu Hsing North Rd., Taipei (TW)

( * ) Notice: Subject to any disclaimer, the term of this patent is extended or adjusted under 35 U.S.C. 154(b) by 0 days.

(21) Appl. No.: 10/125,605

(22) Filed: Apr. 19, 2002

(51) Int. Cl.[7] ..... E06B 9/38

(52) U.S. Cl. ..... 160/178.1 R; 160/902; 248/262

(58) Field of Search ..... 160/176.1 R, 177 R, 160/178.1 R, 902; 248/262

(56) References Cited

U.S. PATENT DOCUMENTS 2,630,861 A * 3/1953 Nelson
5,092,387 A * 3/1992 King et al.
5,180,130 A * 1/1993 McMichael
5,353,857 A * 10/1994 Anderson
6,039,295 A * 3/2000 De Beijer

* cited by examiner

*Primary Examiner*—Blair M. Johnson
(74) *Attorney, Agent, or Firm*—Dennison, Schultz & Dougherty

(57) ABSTRACT

A head structure for Venetian blind includes a head rail having a concave bottom surface, two mounting members assembled to the head rail and invisible from a front side of the head rail, and a slat tilting gear controlled via tilt cords instead of a rigid wand. The concave bottom surface of the head rail has a curvature close to that of slats of the Venetian blind, so that the slats in a fully lifted position can fitly bear against the bottom of the head rail to avoid deformation. The tilt cords, the invisibly assembled mounting members, and the lifted slats fitly bearing against the head rail not only creates beautiful integral appearance for the Venetian blind, but also enables reduced volume thereof for convenient packing and storage.

7 Claims, 6 Drawing Sheets

HEAD STRUCTURE FOR VENETIAN BLIND

BACKGROUND OF THE INVENTION

A conventional head structure for Venetian blind includes a head rail 1' having a flat bottom surface 2, two mounting members 5' visibly assembled to two ends of the head rail 1', and a slat tilting gear 4' generally controlled via a rigid wand 43', as shown in FIG. 1. While the head rail 1' has a flat bottom surface 2, slats 3 of the Venetian blind have an arched profile. When the arched slats 3 are in a fully lifted position, they are in contact with the flat bottom surface 2 of the head rail 1' only in an extremely small area. When the lifted slats 3 are subjected to compression toward the head rail 1' , they tend to deform at two longitudinal edges. The mounting members 5' are normally located at two outer ends of the head rail 1' and have an appearance quietly different from that of the head rail 1' to spoil an integral beauty of the Venetian blind. The wand 43' of the slat tilting gear 4' for tilting the slats 3 is an elongate member downward extended from the bottom of the head rail 1'. It not only adversely affects the integral beauty of the Venetian blind, but also occupies additional space when the slats 3 are lifted for storing or transporting the Venetian blind. Moreover, the wand 43' is easily broken at collision with other things.

It is therefore desirable to develop an improved head structure for Venetian blind to eliminate the above-mentioned drawbacks.

SUMMARY OF THE INVENTION

A primary object of the present invention is to provide an improved head structure for Venetian blind, so that the slats of the Venetian blind would not deform when they are in a fully lifted position, and the whole head structure has a beautiful integral appearance.

To achieve the above and other objects, the head structure for Venetian blind according to the present invention mainly includes a head rail having a concave bottom surface, two mounting members assembled to the head rail and invisible from a front side of the head rail, and a slat tilting gear controlled via tilt cords instead of a rigid wand. The concave bottom surface of the head rail has a curvature close to that of slats of the Venetian blind, so that the slats in a fully lifted position fitly bear against the bottom of the head rail to avoid deformation. The tilt cords, the invisibly assembled mounting members, and the lifted slats fitly bearing against the head rail not only creates beautiful integral appearance for the Venetian blind, but also enables reduced volume of the Venetian blind for convenient packing, storage, and transport thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
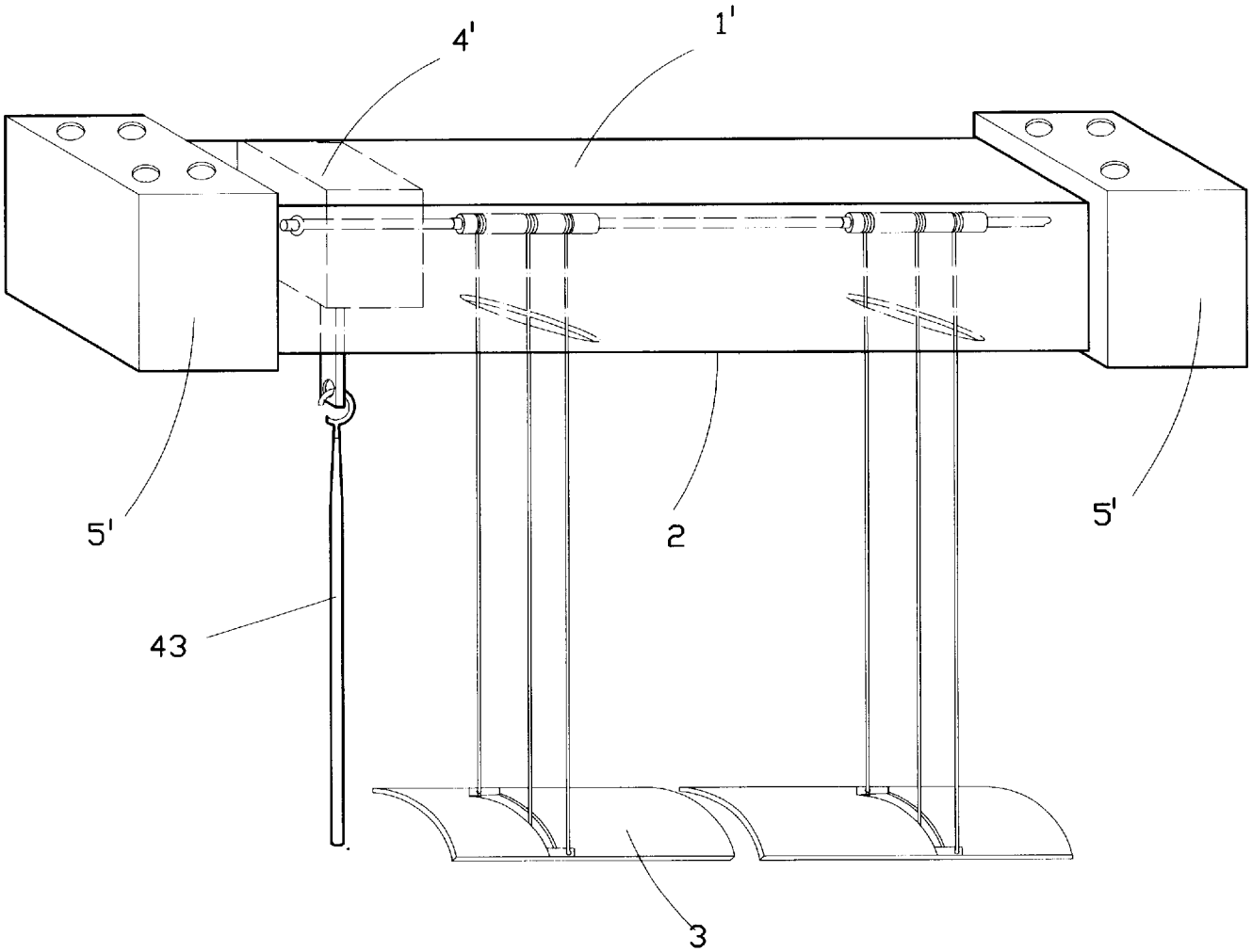
FIG 1 PRIOR ART
FIG. 1 is a schematic view of a conventional head structure for Venetian blind, showing relative positions of a head rail, two mounting members, and a slat tilting gear in the head structure.
Figure 2:
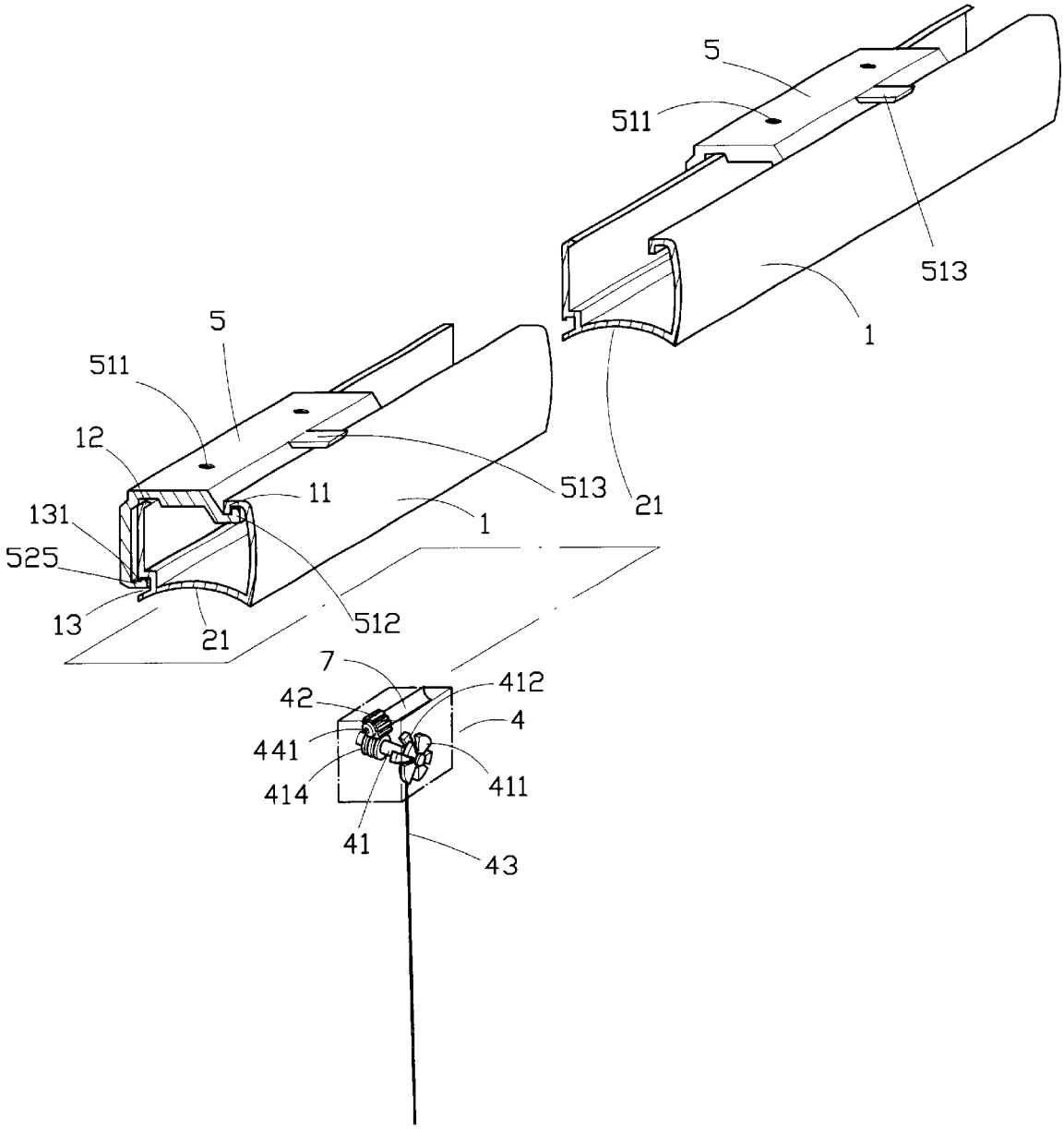
FIG. 2 is a partially exploded perspective view of a head structure for Venetian blind according to the present invention, showing relative positions of a head rail, two mounting members, and a slat tilting gear in the head structure.
Figure 3:
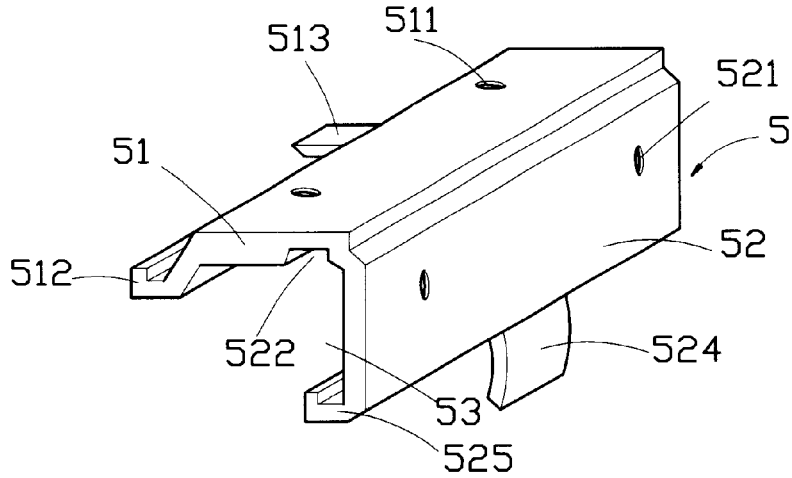
FIG. 3 shows the head rail and the mounting member of the present invention in a separated state.
Figure 3:
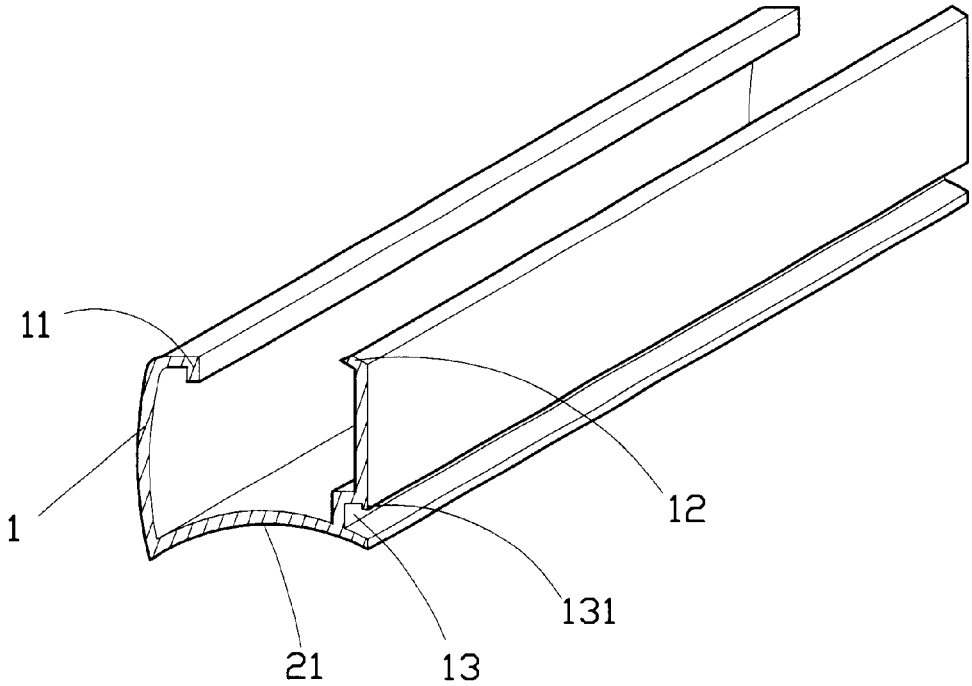
Figure 4:
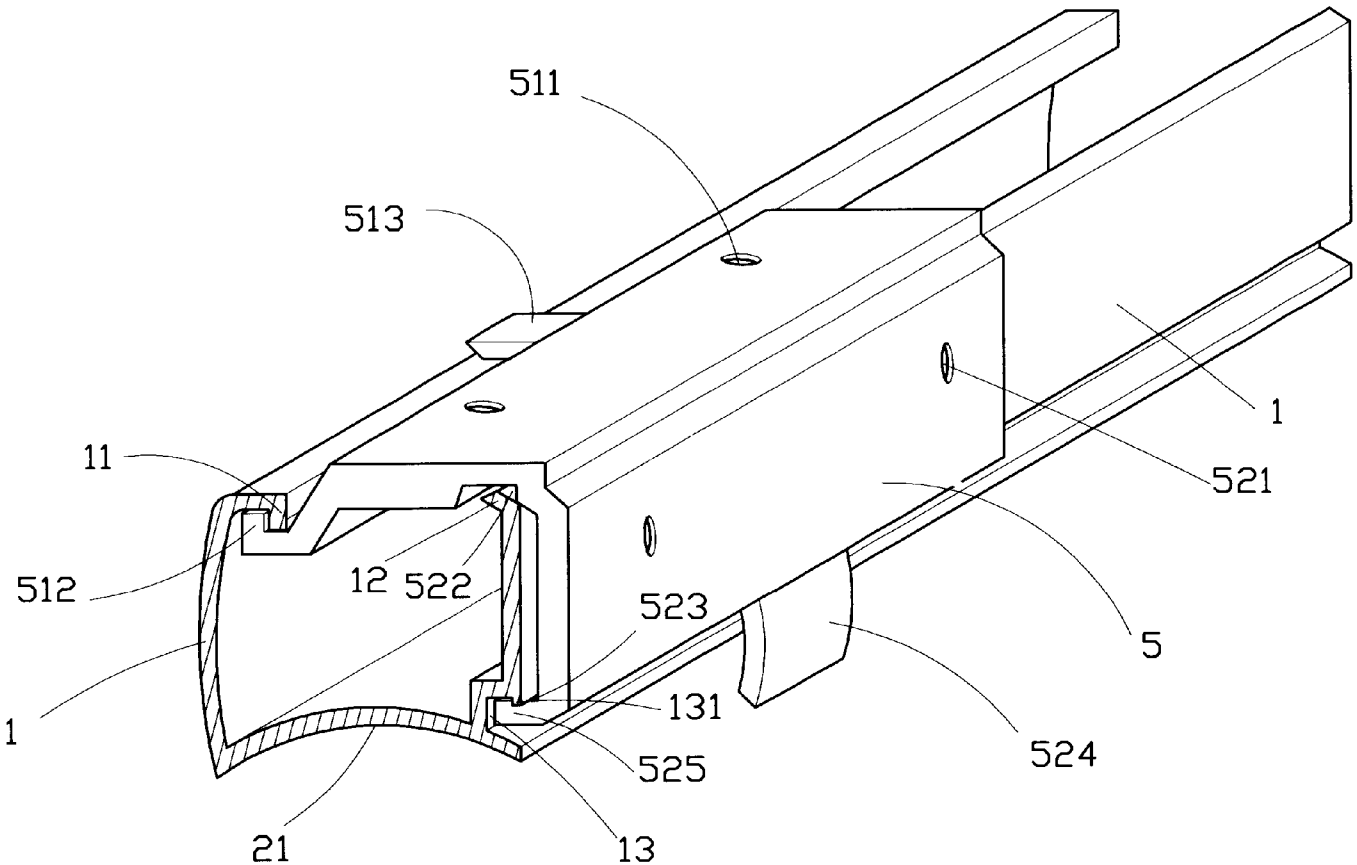
FIG. 4 shows the head rail and the mounting member of the present invention in an assembled state.

Please refer to FIG. 2 that is a partially exploded perspective view of a head structure for Venetian blind according to the present invention. As shown, the head structure for Venetian blind mainly includes a head rail 1, two mounting members 5, and a slat tilting gear 4.

Figure 5:
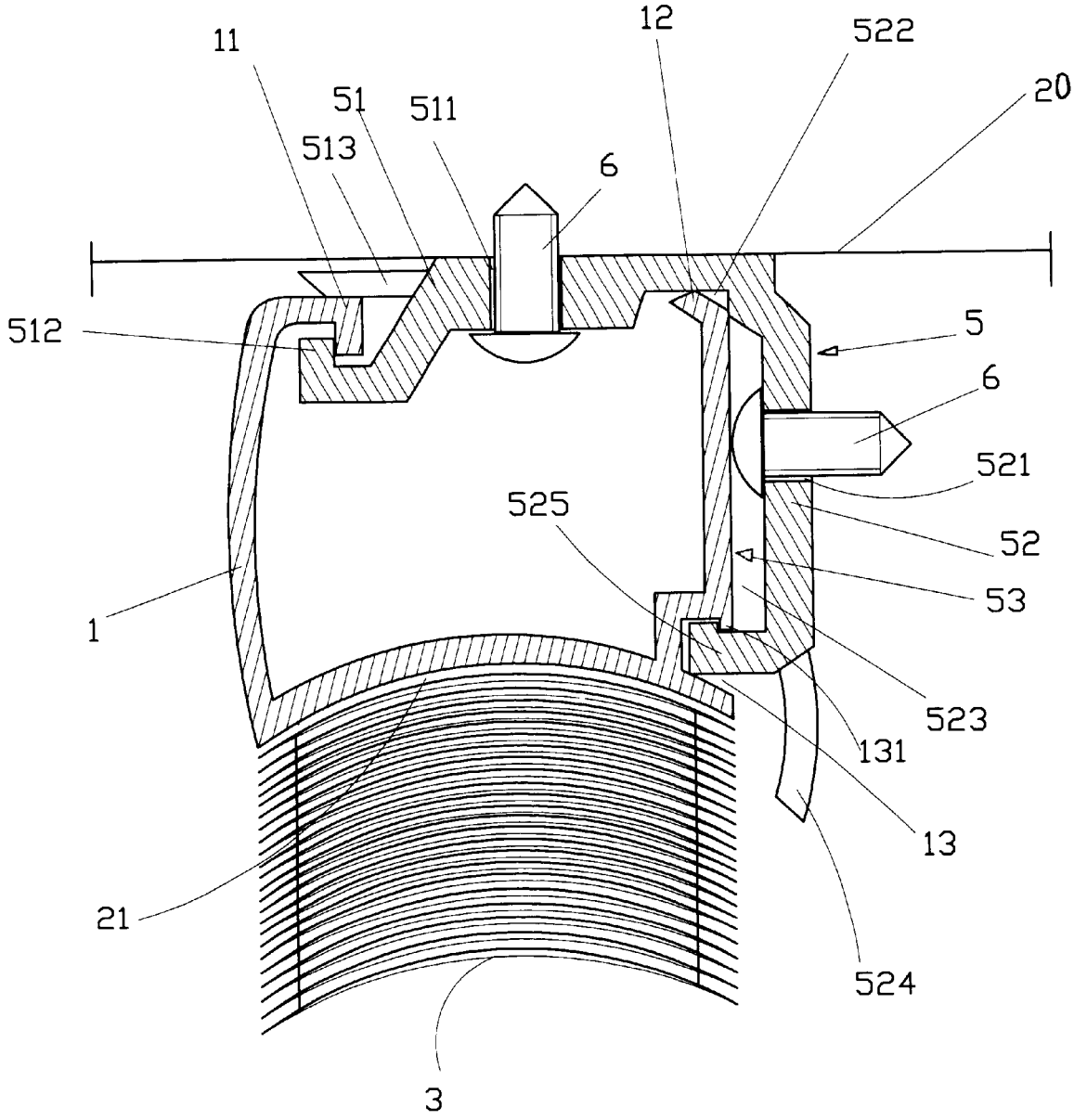
FIG. 5 is an assembled sectioned end view of the head structure for Venetian blind according to the present invention, wherein the slats are fully lifted.

Please refer to FIGS. 2 to 5 at the same time. The head rail 1 is a substantially U-shaped member having a front portion, a bottom portion, and a rear portion. The front portion is provided at an upper end with a rearward and downward extended flange 11 and the rear portion is provided at an upper end with a forward extended flange 12. A lower end of the rear portion adjacent to the bottom portion is forward bent, so that a rearward opened channel 13 is provided between the lower end of the rear portion and a rear end of the bottom portion. The bottom portion defines an upward curved (or concaved) surface 21 that has a curvature close to that of slats 3 of the Venetian blind, such that an uppermost portion of the slats 3 in a fully lifted position is seated in and fitly bears against the concaved surface 21 of the bottom portion, as shown in FIG. 5. The concaved surface 21 of the bottom portion allows the fully lifted slats 3 to occupy less space below the head rail 1. Moreover, since the fully lifted slats 3 fitly bear against the concaved surface 21, they are not subject to deformation due to incomplete contact with and uneven compression against the bottom portion of the head rail.

The mounting members 5 are integrally made of a plastic material through injection molding. Each of the mounting members 5 is a substantially L-shaped member having a top portion 51 and a rear portion 52 that together define a hollow space 53 between them. The top portion 51 and the rear portion 52 of the mounting member 5 are sized for assembling to top and back of the head rail 1 and are provided at predetermined positions with a plurality of mounting holes 511 and 521, respectively. By extending screws 6 through these mounting holes 511, 521, the mounting members 5 can be fixed to a wall 20 or other selected place as actual need (see FIG. 5). The top portion 51 has a front end being bent to form a downward and then upward extended flange 512 and having a holding-down plate 513 forward projected from a predetermined point thereof. The rear portion 52 of the mounting member 5 has a lower end being bent to form a forward and then upward extended flange 525. A channel 522 is formed at an inner side of a joint of the top portion 51 and the rear portion 52. The channel 522 and the flange 525 together define a recess 523 between them and in front of the rear portion 52. A downward extended grip 524 is provided at a predetermined position on the lower end of the rear portion 52. By holding at the grip 524, the mounting member 5 can be more easily mounted to and dismounted from the wall 20.

After the mounting members 5 are fixed to the wall 20 at desired positions, the head rail 1 can be quickly assembled to the mounting members 5 by engaging the rearward and downward extended flange 11 with the forward and upward extended flanges 512, and pushing the rearward opened channel 13 against the forward and upward extended flanges 525 to engage with the latter. As can be seen in the figures, the channel 13 is provided at an upper rear corner with a downward extended rib 131, which bears against an inner side of the flange, 525 to prevent the head rail 1 from separating from the mounting members 5. After the head rail 1 is assembled to the mounting members 5, the forward extended flange 12 at the upper end of the rear portion of the head rail 1 is located in and pressed against a top of the channels 522 at the joints of the top and the rear portions 51, 52 of the mounting members 5, and the holding-down plates 513 on the mounting members 5 are located above and in contact with a top of the flange 11 of the head rail 1. Due to the hollow space 53 that provides the mounting members 5 with some extent of flexibility, the head rail 1 could be quickly assembled to the mounting members 5 in the above-described manner without difficulty.

Figure 6:
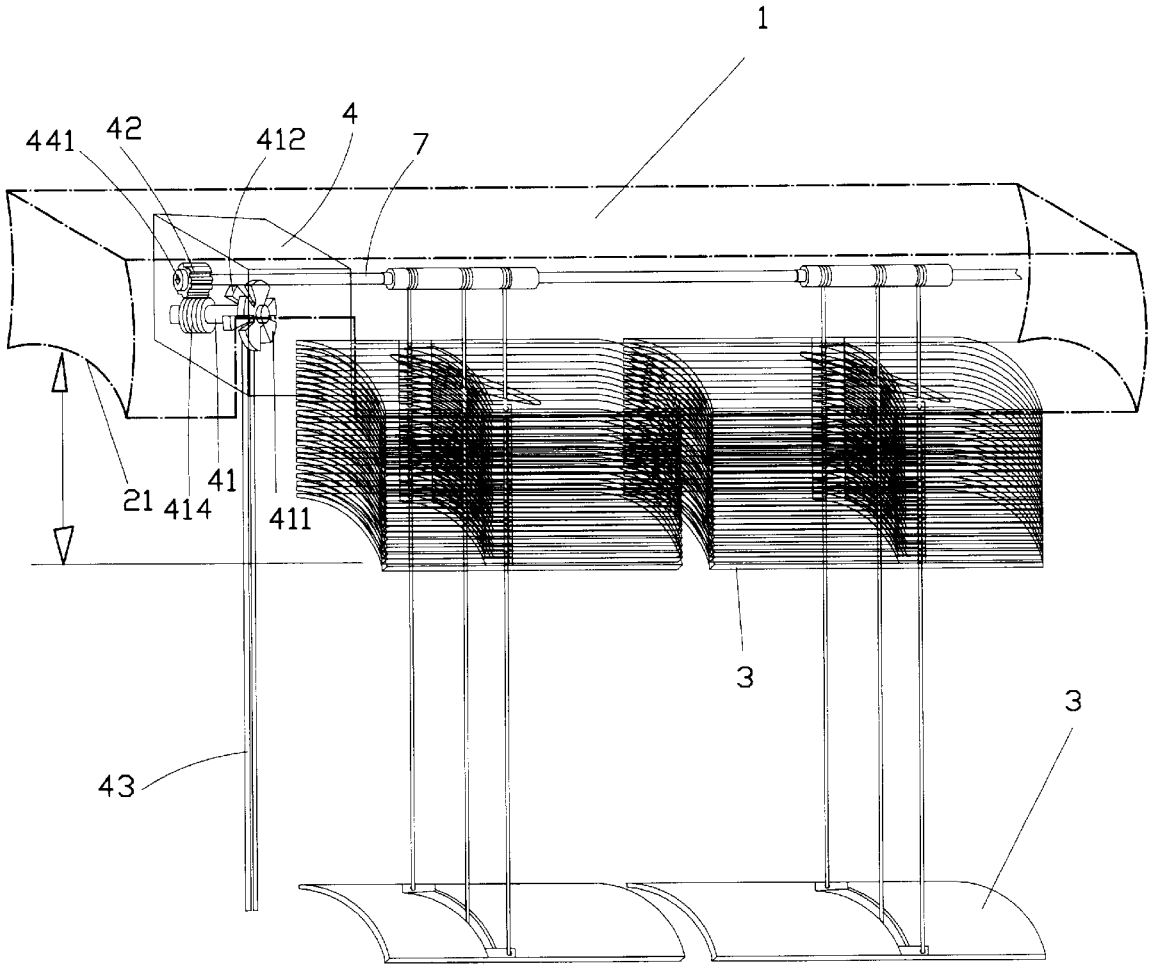
FIG. 6 is a schematic perspective view of the head structure for Venetian blind according to the present invention, wherein the slats are fully lifted.

Please refer to FIGS. 2 and 6. The slat tilting gear 4 includes a shaft 41, a pinion 42, and two tilt cords 43. The shaft 4l is provided at a front end with a turning member including two sets of axially spaced blades 411, 412. Blades 411, 412 in the two sets are staggered in their circumferential positions. The tilt cords 43 are wound around a space between the two sets of blades 411, 412. When any one of the tilt cords 43 is pulled, the shaft 41 is caused to rotate clockwise or counterclockwise. A rear end of the shaft 41 is formed into a screw rod 414. The pinion 42 is located above the screw rod 414 to mesh with the same. When either tilt cord 43 is pulled to turn the shaft 41, the screw rod 414 brings the pinion 42 to rotate at the same time. The pinion 42 has a square central hole 441 for an end of a tilt rod 7 to extend thereinto. The end of the tilt rod 7 has a squared periphery slightly smaller than a perimeter of the square central hole 441 of the pinion 42, such that the tilt rod 7 is brought by the pinion 42 to turn synchronously and thereby tilts the slats 3.

What is claimed is:

1. A head structure for a Venetian blind comprising a substantially U-shaped head rail having a front portion, a bottom portion and a rear portion, two plastic mounting members and a slat tilting gear;

said front portion including an upper end with a rearward and downward extending flange and said rear portion including an upper end with a forward extending flange and said bottom portion defining a concave surface having a curvature close to that of slats in a Venetian blind;

said rear portion including a lower end with forward and downward projections forming a generally C-shaped channel between said bottom portion and said rear portion and a rib formed adjacent to said forward projection;

each of said plastic mounting members made integral by injection molding to define a substantially L-shaped member having a top portion, a rear portion and an open space therebetween;

said top portion of each of said mounting members including a front end forming a downward, forward and upward extending flange and a forward extending hold down plate, and said rear portion of each of said mounting members having a lower end forming a forward and upward extending flange forming a rib and a downward extending grip;

said mounting member constructed for assembly to said head rail with said rearward and downward extending flange of said front portion of said head rail extending over said downward, forward and upward extending flange of said top portion of each of said mounting members and under said hold down plates, and in which said generally C-shaped channel of said rear portion extending over said forward and upward extending flange of said rear portion of each of said mounting members and against said rib and being releasable therefrom by said downward extending grip and whereby said mounting members are not visible from a front side of said head rail; and two tilt cords controlling said tilting gear to tilt slats of said Venetian blind.

2. The head structure for a Venetian blind as claimed in claim 1, wherein said mounting members are provided on said top and said rear portions with a plurality of mounting holes.

3. The head structure for a Venetian blind as claimed in claim 1, wherein said slat tilt gear includes a shaft, a pinion located above a rear end of said shaft, and two tilt cords; and said shaft being provided at a front end with a turning member, and at said rear end with a screw rod.

4. The head structure for a Venetian blind as claimed in claim 3, wherein said turning member includes two sets of axially spaced blades, said blades in said two sets being staggered in their circumferential positions, and said tilt cords being wound around a space between said two sets of spaced blades of said turning member.

5. The head structure for a Venetian blind as claimed in claim 3, wherein said pinion is located above and meshes with said screw rod.

6. The head structure for a Venetian blind as claimed in claim 5, wherein said pinion includes a square central hole for receiving an end of a tilt rod therein.

7. The head structure for a Venetian blind as claimed in claim 6, wherein said end of said tilt rod received in said square central hole of said pinion has a cross section corresponding to and slightly smaller than that of said square central hole of said pinion.

* * * * *